US006632510B1

(12) United States Patent
Waller, Jr. et al.

(10) Patent No.: US 6,632,510 B1
(45) **Date of Patent: *Oct. 14, 2003**

(54) MICROPOROUS INKJET RECEPTORS CONTAINING BOTH A PIGMENT MANAGEMENT SYSTEM AND A FLUID MANAGEMENT SYSTEM

(75) Inventors: Clinton P. Waller, Jr., White Bear Lake, MN (US); James S. Mrozinski, Oakdale, MN (US); Omar Farooq, Woodbury, MN (US)

(73) Assignee: 3M Innovative Properties Company, St. Paul, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/892,902

(22) Filed: Jul. 14, 1997

(51) Int. Cl.[7] ..... B41M 5/00

(52) U.S. Cl. ..... 428/195; 428/206; 428/305.5; 428/308.4; 428/315.5; 428/317.9; 347/105; 427/355; 427/372.2

(58) Field of Search ..... 428/304.4, 305.5, 428/306.6, 308.4, 308.8, 315.5, 317.9, 318.4, 320.2, 331, 404, 407, 206, 207, 195; 427/372.2, 355; 347/101, 105, 106

(56) References Cited

U.S. PATENT DOCUMENTS

| | | | | |
|---|---|---|---|---|
| 4,247,498 | A | 1/1981 | Castro | 264/41 |
| 4,419,388 | A | 12/1983 | Sugiyama et al. | 427/288 |
| 4,474,847 | A | 10/1984 | Schroder et al. | 428/323 |
| 4,539,256 | A | 9/1985 | Shipman | 428/315.5 |
| 4,547,405 | A | 10/1985 | Bedell et al. | 427/256 |
| 4,554,181 | A | 11/1985 | Cousin | 427/261 |
| 4,613,441 | A | 9/1986 | Kohno et al. | 210/500.36 |
| 4,649,064 | A | 3/1987 | Jones | 427/256 |
| 4,726,989 | A | 2/1988 | Mrozinski | 428/315.5 |
| 4,732,786 | A | 3/1988 | Patterson et al. | 427/261 |
| 4,741,969 | A | 5/1988 | Hayama et al. | 428/514 |
| 4,775,594 | A | 10/1988 | Desjarlais | 428/421 |
| 4,781,985 | A | 11/1988 | Desarlais | 428/421 |
| 4,867,881 | A | 9/1989 | Kinzer | 210/490 |
| 4,877,680 | A | 10/1989 | Sakaki et al. | 428/332 |
| 4,892,779 | A | 1/1990 | Leatherman et al. | 428/220 |
| 4,903,039 | A | 2/1990 | Light | 346/1.1 |
| 4,903,040 | A | 2/1990 | Light | 346/1.1 |
| 4,935,307 | A | 6/1990 | Iqbal et al. | 428/500 |
| 4,954,395 | A | 9/1990 | Hasegawa et al. | 428/318.4 |
| 5,079,319 | A | 1/1992 | Mueller | 526/238.23 |
| 5,084,340 | A | 1/1992 | Light | 428/327 |
| 5,102,731 | A | 4/1992 | Takimoto | 428/323 |
| 5,120,594 | A | 6/1992 | Mrozinski | 428/195 |
| 5,126,194 | A | 6/1992 | Light | 428/327 |
| 5,126,195 | A | 6/1992 | Light | 428/327 |

(List continued on next page.)

FOREIGN PATENT DOCUMENTS

| | | |
|---|---|---|
| DE | 196 28 341 | 1/1998 |
| EP | 0 199 874 | 11/1986 |
| EP | 457 728 | 11/1991 |
| EP | 0 484 016 A1 | 5/1992 |
| EP | 0 570 515 B1 | 11/1993 |
| EP | 0 614 771 A1 | 9/1994 |
| EP | 0 627 324 A1 | 12/1994 |
| EP | 0 661 168 A3 | 7/1995 |
| EP | 0 667 246 A1 | 8/1995 |
| EP | 0 673 782 A2 | 9/1995 |
| EP | 0 716 931 A1 | 6/1996 |
| EP | 0 736 392 | 10/1996 |
| EP | 0 791 473 A2 | 8/1997 |
| EP | 0 878 319 A2 | 4/1998 |
| EP | 0 839 880 A1 | 5/1998 |
| EP | 0 876 914 A1 | 11/1998 |
| EP | 0 894 641 | 2/1999 |
| EP | 0 897 808 A1 | 2/1999 |
| GB | 2 147 003 | 5/1985 |
| JP | 61-063476 | 1/1986 |
| JP | 61-41585 | 2/1986 |
| JP | 61-261089 | 11/1986 |
| WO | WO 93/01938 | 2/1993 |
| WO | WO 93/25595 | 12/1993 |
| WO | WO 95/28285 | 10/1995 |
| WO | WO 96/18496 | 6/1996 |
| WO | WO 97/20697 | 6/1997 |
| WO | WO97/33758 | 9/1997 |
| WO | WO 98/02314 | 1/1998 |
| WO | WO 98/05504 | 2/1998 |
| WO | WO 98/05512 | 2/1998 |
| WO | WO98/29516 | 7/1998 |
| WO | WO 98/30749 | 7/1998 |
| WO | WO 99/03685 | 1/1999 |
| WO | WO 99/06216 | 2/1999 |
| WO | WO 99/07588 | 2/1999 |

OTHER PUBLICATIONS

R.E. Kestings, *Synthetic Polymeric Membranes*: Structural Perspective, 2d ed., John Wiley & Sons, 1985 Chapter 7, pp. 237–285. (No Month).

Hornby et al., "Acrylidone Anionic Copolymers," International Specialty Products (brochure), Reprinted from *Soap/Cosmetics/Chemical Specialties* (Jun. 1993) 5 pgs.

International Specialty Products (brochure), Industrial Reference Guide, "Polymers—Polyvinylpryrrolidone," 2 pgs. (No date).

(List continued on next page.)

*Primary Examiner*—Marie Yamnitzky
(74) *Attorney, Agent, or Firm*—Carolyn V. Peters

(57) ABSTRACT

Inkjet receptor media are disclosed that have both a fluid management system and a pigment management system for use with pigmented inkjet inks that produce vibrant, durable images. The fluid management system is provided by microporous media with the presence of surfactants, if needed. The pigment management system is provided by either fluorinated silica particles or multivalent metal salts impregnated into pores of the microporous media. Methods of making and using are also disclosed.

35 Claims, 2 Drawing Sheets

U.S. PATENT DOCUMENTS

| | | | | | |
|---|---|---|---|---|---|
| 5,141,790 | A | | 8/1992 | Calhoun et al. | 428/40 |
| 5,147,410 | A | | 9/1992 | Heindl et al. | 8/555 |
| 5,156,674 | A | | 10/1992 | Cells | 106/20 |
| 5,206,071 | A | | 4/1993 | Atherton | 428/195 |
| 5,208,092 | A | | 5/1993 | Iqbal | 428/195 |
| 5,220,346 | A | | 6/1993 | Carreira et al. | |
| 5,229,207 | A | | 7/1993 | Paquette et al. | 428/355 |
| 5,262,238 | A | | 11/1993 | Trouve et al. | 428/402 |
| 5,296,277 | A | | 3/1994 | Wilson et al. | 428/40 |
| 5,302,437 | A | | 4/1994 | Idei et al. | 428/195 |
| 5,342,688 | A | | 8/1994 | Kitchin | 428/402 |
| 5,362,516 | A | | 11/1994 | Wilson et al. | 427/207.1 |
| 5,374,475 | A | | 12/1994 | Walchli | 428/304.4 |
| 5,380,044 | A | | 1/1995 | Aitkens et al. | 283/67 |
| 5,389,723 | A | | 2/1995 | Iqbal et al. | 525/57 |
| 5,428,383 | A | * | 6/1995 | Shields et al. | 347/96 |
| 5,429,860 | A | | 7/1995 | Held et al. | 428/195 |
| 5,443,727 | A | | 8/1995 | Gagnon | 210/490 |
| 5,445,868 | A | | 8/1995 | Harasawa et al. | 428/206 |
| 5,500,668 | A | | 3/1996 | Malhotra et al. | 347/105 |
| 5,518,534 | A | | 5/1996 | Pearlstine et al. | |
| 5,537,137 | A | | 7/1996 | Held et al. | 347/105 |
| 5,569,529 | A | | 10/1996 | Becker et al. | 428/331 |
| 5,605,750 | A | | 2/1997 | Romano et al. | 428/304.4 |
| 5,624,484 | A | | 4/1997 | Takahashi et al. | 106/31.75 |
| 5,640,187 | A | | 6/1997 | Kashiwazaki et al. | 347/101 |
| 5,677,067 | A | | 10/1997 | Kojima et al. | |
| 5,679,143 | A | | 10/1997 | Looman | 106/20 R |
| 5,681,660 | A | | 10/1997 | Bull et al. | 428/500 |
| 5,683,793 | A | | 11/1997 | Malhotra et al. | 428/216 |
| 5,686,602 | A | | 11/1997 | Farooq et al. | 536/101 |
| 5,688,603 | A | | 11/1997 | Iqbal et al. | 428/532 |
| 5,695,820 | A | * | 12/1997 | Davis et al. | 427/261 |
| 5,707,722 | A | * | 1/1998 | Iqbal et al. | 428/304.4 |
| 5,731,430 | A | | 3/1998 | Fuertes et al. | 536/58 |
| 5,747,148 | A | * | 5/1998 | Warner et al. | 428/212 |
| 5,789,342 | A | | 8/1998 | Evans et al. | 503/227 |
| 5,800,919 | A | | 9/1998 | Peacock et al. | 428/355 |
| 5,863,662 | A | | 1/1999 | Hornby et al. | 428/483 |
| 5,874,143 | A | | 2/1999 | Peloquin et al. | 428/40.1 |
| 5,885,337 | A | | 3/1999 | Nohr et al. | 106/31.27 |
| 6,054,213 | A | | 4/2000 | Peacock et al. | 428/355 |
| 6,071,614 | A | | 6/2000 | Farooq | 428/403 |
| 6,177,187 | B1 | | 1/2001 | Niemoller et al. | 428/327 |

OTHER PUBLICATIONS

International Specialty Products (brochure), Polyvinylpyrrolidone Polymers, "PVP", 16 pgs. (No date).

International Specialty Products (brochure), "Acrylidone™ Anionic Polymers," 6 pgs. (No date).

*Encyclopedia of Polymer Science and Engineering*, vol. 17, pp. 204–214, 229, 234–235, John Wiley & Sons, Inc. (1989). (No Month).

Porterfield, William W., *Inorganic Chemistry*, Addison–Wesley Publ., p. 133, (1984). (No month).

* cited by examiner ( COMPARISON )

MICROPOROUS INKJET RECEPTORS CONTAINING BOTH A PIGMENT MANAGEMENT SYSTEM AND A FLUID MANAGEMENT SYSTEM

RELATED APPLICATIONS

This application is related to a coassigned, U.S. Pat. application Ser. No. 08/892,152, (Farooq et al.), now U.S. Pat. No. 6,071,614, which discloses the manufacture and other uses of a silica agglomerate composition that is also one embodiment of the Pigment Management System of the present invention.

COLOR PHOTOGRAPHS

The file of this patent contains at least one drawing executed in color. Copies of this patent with color drawings will be provided by the Patent and Trademark Office upon request and payment of the necessary fee.

1. Field of Invention

This invention relates to a microporous inkjet receptor that provides excellent images with pigmented inks deposited thereon.

2. Background of Invention

Inkjet imaging techniques have become vastly popular in commercial and consumer applications. The ability to use a personal computer and desktop printer to print a color image on paper or other receptor media has extended from dye-based inks to pigment-based inks. The latter provide brilliant colors and more durable images because pigment particles are contained in a dispersion before being dispensed using a thermal inkjet print head, such as those commercially available from Hewlett Packard Corporation or LexMark Corporation in inkjet printers commercially available from Hewlett Packard Corporation, Encad Inc., Mimaki Corporation, and others.

Ink jet printers have been in general use for wide-format electronic printing for applications such as, engineering and architectural drawings. Because of the simplicity of operation, economy of ink jet printers, and improvements in ink technology the inkjet imaging process holds a superior growth potential promise for the printing industry to produce wide format, image on demand, presentation quality durable graphics.

The components of an ink jet system used for making graphics can be grouped into three major categories:

1 Computer, software, printer.

2 Ink.

3 Receptor sheet.

The computer, software, and printer will control the size, number and placement of the ink droplets and will transport the receptor film. The ink will contain the colorant or pigments which form the image and the receptor film provides the medium which accepts and holds the ink. The quality of the ink jet image is a function of the total system. However, the composition and interaction between the ink and receptor film is most important in an ink jet system.

Image quality is what the viewing public and paying customers will want and demand to see. Many other demands are also placed on the ink jet media/ink system from the print shop, such as rapid drying, humidity insensitivity, waterfastness and overall handleability. Also, exposure to the environment can place additional demands on the media and ink (depending on the application of the graphic).

Porous film is a natural choice to use as an ink jet receptive media because the capillary action of the porous film can wick the ink into the pores much faster than the absorption mechanism of film forming water soluble coatings. However, in the past, when a porous coating or film has been employed to achieve desired quick dry, optical density has suffered greatly because the colorant penetrates too deep into the porous network. This type of problem is magnified by printers that dispense high volumes of ink per drop because extra film thickness may be required to hold all the ink. When the pore size and pore volume of the membrane are opened to allow the pigments to penetrate, the pigments can be stratified in the membrane. Meaning, the black, cyan, magenta, and yellow will be predominately found at different depths depending on the order of application. Furthermore, lateral diffusion of the ink can also be a problem inherent in porous membranes used as receptive media. Hence, some of the first color(s) applied is/are optically trapped in the image by subsequent application of other pigmented ink When pigmented inks are jetted onto a porous film that has a pore size that is too small, color pigments will be filtered on the top of the membrane rendering high image density, but the pigments will easily smear and have the effect of never drying. Also, excess fluid from the ink can pool and run on the image before the water/glycol carrier is wicked away.

The chemical formulation of the pigmented inkjet ink has considerable complexity due to the requirement of continued dispersion of the pigment particles in the remainder of the ink.

The typical consumer medium for receiving dye-based inkjet inks has been paper or specially coated papers. However, with too much inkjet ink in a given area of the paper, one can see the over-saturation of the paper with the aqueous ink in which dye was dissolved.

As inkjet inks have become more commercially oriented and pigmented-based inks have become more prevalent, different media have been tried in an attempt to control the management of fluids in the ink. For example, copending, coassigned, U.S. patent application Ser. No. 08/614,986 (Steelman et al.), now abandoned, combines a hygroscopic layer to manage fluids in the ink with a hydrophilic layer thereon, upon which the ink can be deposited. Pigment particles remain with the hydrophilic layer while fluids pass through to the hygroscopic layer for rapid drying.

Ink receptive element containing absorptive polymers and polymer particles together with a binder has been disclosed in U.S. Pat. No. 5,084,340.

U.S. Pat. No. 4,781,985 discloses an inkjet transparency film comprising a substantially transparent resinous support containing a clear absorptive coating thereon.

U.S. Pat. No. 5,102,731 mentioned the use of a non-porous substrate and a coating layer formed thereon comprising a carboxyl group-containing ionomeric hydrophilic urethane resin and organic and/or inorganic fine particles.

U.S. Pat. No. 4,954,395 discloses a recording medium which comprises a porous ink-transporting layer and a non-porous ink-retaining layer.

German Patent No. 30 24 205 uses a pigment/binder mixture on the ink receiving paper. The purpose of the pigment is to add whiteness and porosity. A high pigment load leads the film to high porosity. This makes the paper smudge proof but this has a negative effect on optical density, because the dyes in the ink are drawn into the interior of the material.

Japanese Patent JP 61-041585 discloses a method for producing printing material using a ratio of PVA/PVP. The disadvantage is inadequate waterfastness and wet rub off properties.

Japanese Patent JP61-261089 discloses a transparent material with cationic conductive resin in addition to a mixture of PVA/PVP. The material is water fast and smudge proof but the wet rub off properties are poor.

U.S. Pat. No. 5,569,529 discloses a coating with PVP/PVA with water soluble compounds containing aldehyde groups. They also added quaternary ammonium compounds such as polydiallyldimethylammonium chloride. Plus on the backside of the paper they coat on hydropilic colloidal binders such as starch, PVA, or oxidized potato starch. Some color density is lost when submerged in water but after the initial loss it is resistant to further color loss by a weak rubbing test.

European Patent Publication EP 0 716 931 A1 discloses a system using a dye capable of co-ordinate bonding with a metal ion in two or more positions. Again binder resins are used with inorganic pigments in the paper or film. The metal ion was preferred to be jetted on before imaging and additional heating is necessary to complete the reaction. This system was not claiming to be water fast; the focus was long term storage without fading from heat or light.

U.S. Pat. No. 4,419,388 discloses a waterproofing system where after imaging one sprays on a compound containing a mono-valent metal atom or ammonium group with a tri-valent metal atom. An example of these compounds claimed are $KAl(SO_4)_2.12\ H_2O$. Claim 8 discloses aluminum sulfate can be applied to the paper before imaging, but the mono-valent component then has to be in the ink.

U.S. Pat. No. 5,537,137 discloses a system to achieve waterfastness by curing with heat or UV light. In the body of the patent, examples of their coatings contained Ca++ from $CaCl_2$. This was added to provide reactive species for the acid groups on the dispersed polymer. The coating remains water soluble until UV or heat curing after imaging.

U.S. Pat. No. 4,649,064 uses multivalent metal salts in a gelatin coating to cross-link inks that contain polyesteramide with sulfonate functional groups. The ink receiving layer is crosslinked with bis(vinylsulfonylmethyl)ether. Careful selection of materials is required because the metal salts are capable of cross-linking the gelatin coating before the ink is applied.

U.S. Pat. No. 4,732,786 also uses an insolubilized hydrophilic polymer (gelatin) with polyvalent cations from metallic salts and claims advantages with their methods because they can make the coating with a low pigment/binder ratio.

U.S. Pat. No. 5,429,860 discloses an ink/receptor system that may contain multivalent cations. This system is UV activated after imaging to cross-link the materials.

Hence, the current special ink jet media employ vehicle absorptive components, and sometimes optional additives to bind the inks to the media. As a consequence current media are inherently moisture sensitive and can be fragile to handling and subject to finger smearing. Moreover, the vehicle absorptive components usually consist of water soluble (or swelling) polymers which result in slower printing speeds and dry times.

Pigmented ink delivery systems have also dealt with pigment management systems, wherein the resting location of the pigment particles are managed to provide the best possible image graphic. For example, copending, coassigned, U.S. Pat. No. 5,747,148 (Warner et al.) discloses a pigment management system in which a suitable supporting layer (including in a listing a microporous layer) has a two layer fluid management system: a protective penetrant layer and a receptor layer, both layers containing filler particles to provide two different types of protrusions from the uppermost protective penetrant layer. Electron microphotographs in that application show how the pigment particles of the ink encounter smooth protrusions that provide a suitable topography for pigment particle "nesting" and rocky protrusions that assist in media handling and the like.

Other ink receptors have been disclosed, including U.S. Pat. Nos. 5,342,688 (Kitchin); 5,389,723 and U.S. Pat. No. 4,935,307 (both Iqbal et al.); U.S. Pat. No. 5,208,092 (Iqbal) U.S. Pat. No. 5,302,437 (Idei et al); U.S. Pat. No. 5,206,071 (Atherton et al.); and EPO Patent Publication 0 484 016 A1.

SUMMARY OF THE INVENTION

While each of the fluid management systems and each of the pigment management systems of the above prior efforts are suitable for the uses intended, none of these prior disclosures recognizes the need for an inkjet receptor that has both a pigment management system for flocculating or agglomerating incoming ink and a fluid management system for efficiently dispensing with the carrier fluids within a porous substrate.

What is needed is new technology to permit the use of porous membranes that will achieve high quality imaged graphics with quick drying without water soluble/swellable polymers, or additional processing, or the current porous film drawbacks discussed above. Another need in the art is the ability to tailor a microporous medium based on the ink used and the printer configurations.

Furthermore, no two inks are exactly alike in formulation and no clear printer configuration standard has emerged. This variability in the marketplace requires adjustment in the remaining element of the ink jet printing system that is in control of the user, the receptor medium employed.

While Warner et al. above discloses the use of a microporous medium as the supporting layer, Warner et al. provide their fluid management system using two coating layers. The art needs a microporous receptor that does not require coating layers on a major surface of the receptor yet provides both pigment and fluid management systems.

One aspect of the present invention is an inkjet receptor medium, comprising a porous substrate having a fluid management system and having a pigment management system in contact with surfaces of pores of the substrate therein.

Another aspect of the invention is an inkjet receptor comprising a microporous membrane impregnated with a multivalent metal salt together with a surfactant or combination of surfactants chosen for the ink and membrane being employed.

Another aspect of the present invention is an inkjet receptor comprising a microporous membrane impregnated with a microporous fluorinated silica agglomerate together with a binder and a surfactant or a combination of surfactants for the ink and membrane being employed.

Another aspect of the present invention is an inkjet receptor comprising a microporous membrane impregnated with a microporous fluorinated silica agglomerate together with a binder and a surfactant or combination of surfactants wherein the said surfactants are selected from the group of hydrocarbon-based anionic surfactants, silicon-based non-ionic surfactants or fluorocarbon-based non-ionic based surfactants or a combination thereof.

The novel receptors, when imaged in an inkjet printer, provide very high density and very high quality images which are tack-free and instantaneously dry to touch.

Another aspect of the present invention is an impregnation for a porous media/ink set, making possible high speed production of high quality graphic images for current and future ink jet technologies. The imbibed porous substrate provides improved durability, waterfastness, smear resistance, effective quick dry times, and long term durability using porous film without absorptive polymeric binders, or additional process such as UV exposure or heating. Accordingly, the invention provides a media/ink set comprising: a microporous membrane that bears a surface modifier impregnated therein, containing wetting surfactant(s) and a water soluble multivalent metal salt(s), and an ink that contains pigment colorants.

In a preferred embodiment, the ink colorant is a pigment dispersion having a dispersant that binds to the pigment that will destabilize, flocculate, agglomerate, or coagulate the pigments on contact with the media component. Depositing each of colors at or just below the surface of the membrane allowing the carrier fluid to wick into the membrane where the fluid management system can take over while providing a sheltered location for the pigments as managed by the colorant management system.

Also preferred for the receptive media is a Thermally Induced Phase Separated (T.I.P.S.) microporous membrane disclosed in U.S. Pat. No. 4,539,256 (Shipman) and available from 3M. For optimization, the pore size and pore volume of the porous film can be adjusted for the model or make of the ink jet printer to correctly hold the volume of ink dispensed by the printer ensuring the highest possible image quality. The coating on the preferred media/ink set has special utility in the demanding ink jet printing applications found in commercial printing.

A feature of the present invention is the ability to "fine tune" the properties of receptors of the present invention to deal with the variables of inkjet ink delivery, including without limitation: drop volume, porosity of media, and capacity of media to receive ink.

Another feature of the present invention is that it allows the use of complex porosity in a porous material that provides both a tortuous path for fluid management and a tortuous path that ensnares the pigment initially and continually during ink delivery. A variety of presently commercially microporous media that have tortuous paths become useful when completed according the methods of the present invention which is a major limitation of the teachings of U.S. Pat. No. 5,374,475 (Watchli et al).

Another feature of the present invention is the ability to use the present invention for very rapid printing of brilliant, pigmented inkjet inks that dry rapidly as well.

Another feature is satisfaction of many goals of inkjet printing: is competitive in cost; works with pigmented inks; has high resolution; has high color density; has a wide color gamut; is waterfast; is smudge resistant; uses capillary action of the porous membrane for rapid fluid absorption (effective quick dry); does not show banding or coalescence; doesn't show finger prints when handled before or after printing; is a brighter white that does not yellow in time; is stable during temperature and humidity swings; is very outdoor durable with or without an overlaminate; has long shelf life; and is superior when backlighting is used.

An advantage of the present invention is ease of manufacture of microporous receptors without topcoats.

Another advantage of the present invention is the images look excellent for reflective or backlit viewing without heat collapsing the porous substrate as is necessary according to U.S. Pat. No. 5,374,475 (Walchli et al.)

Another advantage of the present invention is very fast-drying of the impregnated salt or microporous silica/surfactant system during coating. The process helps save significant amounts of energy.

Optional additives such as stabilizers, ultraviolet light absorbers, anti-oxidants, mold inhibitors, dye mordants, binders, or polymers can be introduced into the receptors of the present invention so long as they do not interfere with the pigment or fluid management systems.

Optional additional layers can reside on a major surface designated for imaging, such as overlarninates and clear coatings that protect the image graphic. Alternatively, optional additional layers can reside on a major surface opposing the imaging surface, such as stronger layers for laminate construction or adhesive layers for adhesion of the image graphic to an installation surface, either permanently or temporarily. A release liner can be used to protect the adhesive layer during imaging and storage.

Other features and advantages will become identified in discussing embodiments of the invention, using the following drawings.

EMBODIMENTS OF INVENTION

Microporous Substrates

Figure 1:
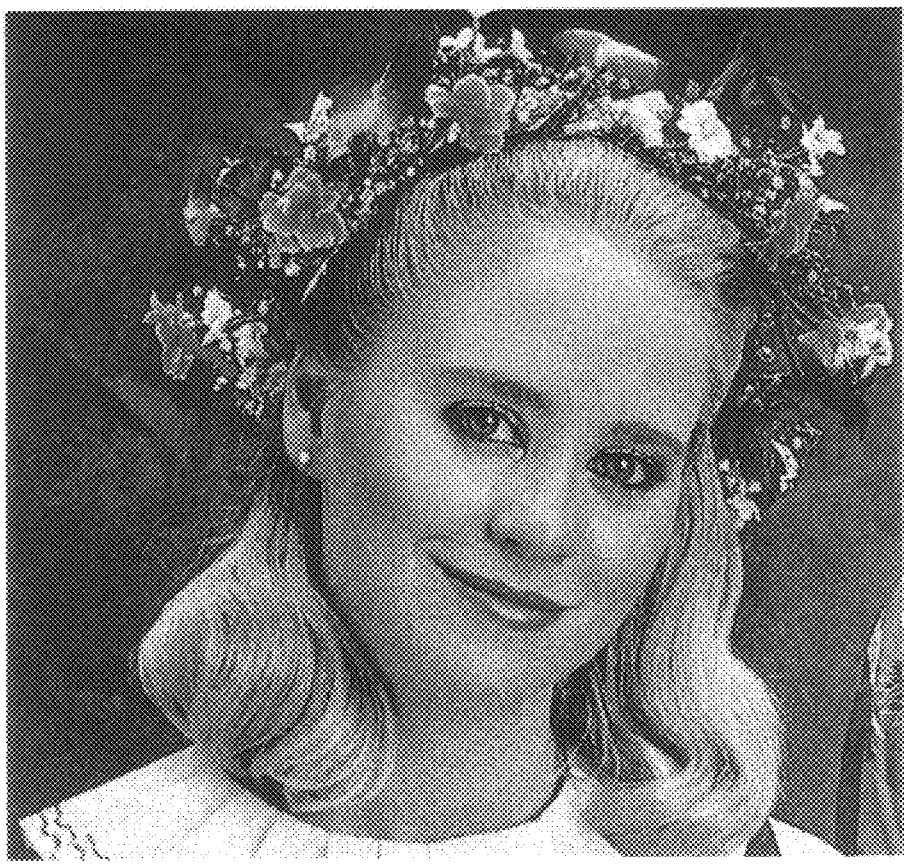
FIG. 1 discloses a color photograph showing one embodiment of the receptor medium of the present invention having a pigment management system and a fluid management system.

Porous substrates useful in the present invention include symmetrical membranes, asymmetrical membranes, and porous films also known as skinned membranes. Symmetrical membranes have porosity on opposing major surfaces of approximately the same pore size. Asymmetrical membranes have porosity on opposing major surfaces that are not of similar pore sizes. A skinned membrane has considerable porosity on one major surface but essentially no porosity on the opposing major surfaces.

Nonlimiting examples of commercially available microporous membranes include: nylon and polysulfone membranes from Gelman Sciences, Ann Arbor Mich. polyolefin membranes from Amoco Corp., Chicago Ill.; and polyolefin, nylon, or ethylene vinyl alcohol membranes from 3M.

A suitable microporous membrane for printing on a 100–140 picoliter per drop size for each color and 300×300 drops per inch printer has a thickness or caliper ranging from about 75 $\mu$m to about 200 $\mu$m, and preferably from about 100 $\mu$m to about 175 $\mu$m. It is a reality of ink jet printing that as many as four pigment drops, representing each of the four printing colors, are landing on a single spot of the ink jet receptor medium in order to generate any one of the myriad of colors available in ink jet printing.

The microporous membrane can have a porosity value as calculated by measuring the bulk density of the membrane in grams/cm$^3$ from the specific gravity measurement determined according to ASTM-D-792–66 and substituting that value into the following formula:

$$100\times[1-\text{measured density/polymer density}]=\text{porosity},$$

ranging from 20 to about 95 and preferably from about 30 to about 50. Alternatively, the membrane can have a pore volume ranging from about 80 to about 100% of the anticipated ink volume dispensed from a given inkjet printer.

Bubble point is a measurement of the largest effective pore size in a symmetrical membrane that has through-porosity, as measured according to ASTM F-316, and can range from about 0.20 μm to about 2.0 μm and preferably about 0.40 μm to about 0.80 μm.

Surface energy of the porous substrate before treating with the pigment and fluid management systems can range from 20 to 70 dynes/cm as defined in the Third Edition of the POLYMER HANDBOOK by J. Brandrup and E. H. Immergut (1989).

Microporous membranes can be of unlimited length, depending on the size of the roll that can be facilely handled. Usually, commercial quantities of the microporous membrane for feeding into a commercial printer can be a roll having a length in excess of 10 meters, and preferably in excess of 20 meters.

As inkjet media become more useful with wide format inkjet printers, the width of the microporous membrane becomes important from a perspective of imaging productivity and convenient graphic installation. The membrane can have a width ranging from about 0.25 meters to about 2 meters and preferably a width ranging from about 0.60 meters to about 1.2 meters.

A particularly preferred microporous membrane for the present invention when printing with a 140 picoliter/drop×4 colors×300×300 drops/inch is a polypropylene membrane prepared using thermally induced phase separation techniques according the disclosures of U.S. Pat. No. 4,539,256 (Shipman et al.), U.S. Pat. No. 4,726,989 (Mrozinski), and more particularly U.S. Pat. No. 5,120,594 (Mrozinski), the disclosures of which are incorporated herein by reference. This membrane has the following properties:

| | |
|---|---|
| Bubble point | ~0.65 μm |
| Gurley 50 cc | 20 sec |
| Porosity % void | 45% |
| Surface wetting Energy (before treatment) | 30 dynes/cm$^2$ |
| Caliper | 0.178 mm (7 mil) |

Fluid Management System

The porosity, Gurley resistance to air flow, pore volume, surface energy, and caliper of the microporous membrane can be selected to provide suitable fluid management for the image graphic. Therefore, depending upon the pigmented ink selected for imaging, the type of ink can determine the type of porous surface most suitable for wicking of fluid from the deposited image graphic into the pore volume of the membrane. Sometimes, the chemical and physical properties of the porous surface requires assistance from surfactants or hydrophilic polymers to aid in the management of ink fluids.

Therefore, a variety of surfactants or polymers can be chosen to provide particularly suitable surfaces for the particular fluid components of the pigmented inkjet inks. Surfactants can be cationic, anionic, nonionic, or zwitterionic. Many of each type of surfactant are widely available to one skilled in the art. Accordingly, any surfactant or combination of surfactants or polymer(s) that will render said substrate hydrophilic and can be employed.

These surfactants can be imbibed into porous surfaces of the membrane. Various types of surfactants have been used in the coating developed systems. These may include but are not limited to fluorochemical, silicon and hydrocarbon-based ones (particularly, long-chain fatty acids) wherein the said surfactants may be anionic or non-ionic. Furthermore, the non-ionic surfactant may be used either as it is or in combination with another anionic surfactant in an organic solvent or in a mixture of water and organic solvent, the said organic solvents being selected from the group of alcohol, amide, ketone and the like.

Various types of non-ionic surfactants can be used, including but not limited to: Dupont's Zonyl fluorocarbons (e.g., Zonyl FSO); 3M's FC-170 or 171 surfactants; BASF's (Pluronic) block copolymers of ethylene and propylene oxide to an ethylene glycol base; ICI's (Tween) polyoxyethylene sorbitan fatty acid esters; Rohm and Haas's (Triton X series) octylphenoxy polyethoxy ethanol; Air Products and Chemicals, Inc. (Surfynol) tetramethyl decynediol; and Union Carbide's Silwet L-7614 and L-7607 silicon surfactants and the like known to those skilled in the art.

Various types of hydrocarbon-based anionic surfactants can also be used, including but not limited to: American Cyanamid's (Arerosol TO) surfactants like dioctylsulfosuccinate-Na-salt or dialkylsulfosuccinate-Na-salt.

Various types of cationic surfactants can also be used, including but not limited to: benzalkonium chloride, a typical quaternary ammonium salt.

Pigment Management System

The microporous material has a pigment management system based on addition of materials into the pore volume of the porous substrate.

Two embodiments are disclosed for the Pigment Management System: Silica Agglomerates and Multivalent Metal Salts. There are benefits of both and some distinctions that can be employed by those skilled in the art to advantage.

Both embodiments provide a quick dry, high color density, high resolution image that is smudge resistant (if the silica agglomerates reside below the exposed surface of the receptor medium).

The silica agglomerate embodiment works with both dye-based and pigment-based inks, whereas the metal salt embodiment works better with pigment-based inks.

The silica agglomerate is not soluble in water either for preparing imbibing solutions or after imaging. The metal salt is soluble in water for both preparing solutions and during imaging, but not after complexing with the dispersing aid that surrounds the pigment particles in the ink.

The silica agglomerate is composed of particles trapped inside the porous receptor medium, whereas the metal salt is composed of coatings on the interior surfaces of the porous receptor medium.

The silica agglomerate is believed to serve as a chemical trap, a functionalized silica, of ink passing through the interior pores interacting with dispersants that surround pigment particles, leaving the colorant with the agglomerate, providing a chemical means of pigment management based on particulates within the pores. The metal salt is believed to serve as reagents to rapidly destabilize dispersants surrounding the pigment particles in the ink, whereby the pigment particles coagulate or flocculate as the remainder of the ink fluid continues through pores and along the surfaces of the receptor medium. The multivalent salts therefore provide a chemical means of pigment management along surfaces of the pores.

The former requires penetration into the porous receptor medium to minimize physical removal from the medium.

The latter coats surfaces of the receptor medium and, once dried, is resistant to physical removal.

One way to qualify various pigment management systems is to place a quantity of the targeted ink into a solution of a pigment management system. A non-particulate chemical acting as in pigment management will flocculate and separate the pigment particles from the ink, rapidly separating the appearance of the experimental liquid into two layers, whereas a particulate chemical acting pigment management will not separate rapidly the experimental liquid into two layers.

While two embodiments are described in more detail below, one skilled in the art can also employ other compositions to provide either primarily physical or primarily chemical means of pigment management without departing from the scope of the present invention.

Silica Agglomerates

One embodiment of the pigment management system used in the present invention relies on fluorinated silica agglomerates filling at least a significant portion of the pore volume of the microporous material. The silica-agglomerates are hydrophobic and are sympathetic with pigment particles dispersed within a pigmented ink.

Details of the preparation of fluorinated silica particles is disclosed in copending, coassigned U.S. Pat. application Ser. No. 08/892,152 (Farooq et al.), now U.S. Pat. No. 6,071,614, the disclosure of which is incorporated herein by reference. Briefly, the preparation can be represented by the following equation:

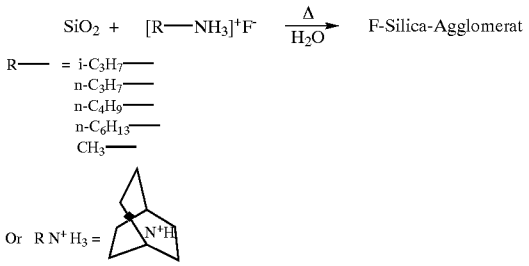

The size of the silica particles can range from about 0.1 to about 50 $\mu$m and preferably from about 1 to about 10 $\mu$m.

The amount of the silica particles can range from about 2 to about 20 weight percent and preferably from about 3 to about 10 weight percent. Impregnation of the silica particles into the pore volume of the microporous membrane requires the particles not to be oversized and operates according the discussion above.

One advantage of functionalized silica particles discussed above is their microporosity which can aid in the physical interaction of pigment particles in ink moving through the pores of the substrate. A more important advantage is their functionalized surfaces for interaction with dispersants engaged with those pigment particles.

Multivalent Metal Salts

A second embodiment of the pigment management system relies on a multivalent metal salt or salts to control the reception of pigment particles onto the porous surfaces of the receptor.

Nonlimiting examples of multivalent metal salts useful in the present invention include the metal cations from Group II and above in the Periodic Table, such as Ca, Mg, Ti, Zr, Fe, Cu, Zn, Ta, Al, Ga, Sn. Examples include a single salt, a binary salt, or a ternary salt containing counterions such as nitrate, sulfate, nitrite, acetate, sulfite, bisulfite, alkanesulfonate, fluoroalkanesulfonates, perchlorate, halide, pseudo-halides, propionate, and the like, and combinations thereof.

Other examples of multivalent metal salts depend on and operate within the conditions of solubility rule concerning the dissolving of salts in water, (*General Chemistry Principles and Structure* $5_{th}$ *edition* p. 132). These rules have hierarchy, meaning if there is conflict with a rule, the preceding rule takes precedence. For example, rule 8 states all carbonates ($CO_3^{-2}$) are insoluble in water. The exceptions to this rule are found when following rules 1 and 2, which is all salts of the alkali metals and all salts of the ammonium ($NH_4^+$) ion are soluble. To employ these rules means that the ammonium and the alkali metal salts do not flocculate ink on contact when imbibed in the porous membrane. Therefore, the salts formed by the carbonate ion are not as useful as other counter ions. As another example, the salt, NaCl, does not flocculate the ink as it contains only the +1 cation (sodium) found in Group 1A of the Periodic Table. The salt, $CaCl_2$, does flocculate the ink as the +2 (calcium) is found in Group IIA.

Specific examples of preferred salts include aluminum sulfate, aluminum nitrate, gallium nitrate, ferrous sulfate, chromium sulfate, calcium propionate, zinc sulfate, zinc acetate, zinc chloride, calcium chloride, calcium bromide, magnesium sulfate, magnesium chloride, and combinations thereof. These compounds are typically sold and can be used in the hydrated form. Of the various possible salts, aluminum sulfate is presently preferred.

The amount of salts that can be used in the coating solution for imbibing in the porous substrate of the present invention can range from about 0.5 wt % to about 50.0 wt %, and preferably from about 1.0 wt % to about 10.0 wt %.

Optional Additives

Stabilizers

Optionally, heat or ultraviolet light stabilizers can be used in receptors of the present invention. Nonlimiting examples of such additives include Ciba-Geigy's Tinuvin 123 or 622LD, or Chimassorb 944 (hindered amine light stabilizers), and BASF's Uvinul 3008. Such stabilizers can be present in a coating solution to be impregnated into the membrane in the range from about 0.20 weight percent to about 20.0 weight percent. Preferably, the stabilizer is present in an amount from about 1.0 to about 10.0 wt %.

Absorbers

Optionally, ultraviolet light absorbers can be used in receptors of the present invention. Nonlimiting examples of such absorbers include Ciba-Geigy's Tinuvin 1130 or 326, BASF's Uvinul 4050H, and Sandoz Chemical Corp.'s Sanduvor VSU or 3035. Such absorbers can be present in the coating solution and can range from about 0.20 weight percent to about 20.0 weight percent. Preferably, the absorber is present in an amount from about 1.0 to about 10.0wt %.

Anti-Oxidants

Optionally, anti-oxidants can be used in receptors of the present invention. Nonlimiting examples of such anti-oxidants include Ciba-Geigy's Irganox 1010 or 1076, BASF's Uvinul 2003 AD, and Uniroyal Chemical's. Such anti-oxidants can be present in the coating solution and can range from about 0.20 weight percent to about 20.0 weight percent. Preferably, the anti-oxidant is present in an amount from about 0.40 to about 10.0 wt %.

Optional Additional Layers

While a receptor of the present invention has two major opposing surfaces and can be employed for inkjet reception on both surfaces, more likely but optionally, one of the major surfaces can be dedicated for the purpose of adhering the finished image graphic to a supporting surface such as a wall, a floor, or a ceiling of a building, a sidewall of a truck, a billboard, or any other location where an excellent quality image graphic can be displayed for education, entertainment, or information.

Minnesota Mining and Manufacturing Company (3M) offers a variety of image graphic receptor media and has developed an array of pressure sensitive adhesive formulations that can be employed on the major surface opposing the surface intended for imaging. Among these adhesives are those disclosed in U.S. Pat. No. 5,141,790 (Calhoun et al.); U.S. Pat. No. 5,229,207 (Paquette et al.); U.S. Pat. No. 5,296,277 (Wilson et al.); U.S. Pat. No. 5,362,516 (Wilson et al.); EPO Pat. Pub. EP 0 570 515 B1 (Steelman et al.), and coassigned U.S. patent application Ser. No. 08/775,844 (Sher et al.), now U.S. Pat. No. 6,197,397; Ser. No. 08/613,753 (Peacock et al.), now abandoned; and Ser. No. 08/606,988 (Peloquin et al.) now abandoned; the disclosures of all of which are incorporated by reference herein.

Any of these adhesive surfaces should be protected by a release or storage liner such as those commercially available from Rexam Release of Oakbrook, Ill. USA.

Alternatively to adhesives, mechanical fasteners can be used if laminated in some known manner to that opposing major surface of the receptor of the present invention. Nonlimiting examples of mechanical fasteners include hook and loop, Velcro™, Scotchmate™ and Dual Lock™ fastening systems, as disclosed in PCT Patent Application Serial No. US97/03490(Loncar),the disclosures of which are incorporated by reference herein.

While the imaging major surface is not covered before imaging, after imaging, the invention can benefit from an optional layer applied to that imaged major surface to protect and enhance the image quality of the image on the receptor. Nonlimiting examples of optional layers are overlaminates and protective clear coatings commercially available from Minnesota Mining and Manufacturing Company (3M) from its Commercial Graphics Division and those disclosed in coassigned U.S. patent application Ser. No. 08/613,741 (Bull et al.), now U.S. Pat. No. 5,681,660, the disclosure of which is incorporated by reference herein. Other products known to those skilled in the art can also be used.

Method of Making the Invention

The invention in its preferred mode is made by first making the microporous substrate using the techniques of TIPS disclosed in Shipman et al or either Mrozinski patent identified above, followed by impregnation of surfactants, as needed, and the pigment management system of multivalent metal salts or silica agglomerates or others. After the receptor is prepared, it can be imaged using conventional thermal ink jet imaging techniques embodied in commercially available printers.

Optional steps after imaging include a fusing of the imaged media according to the teachings of U.S. Pat. No. 5,443,727 (Gagnon) or a backfilling of the remaining pore volume with any material having an index of refraction that is similar to the index of refraction of the imaged receptor of the present invention. Nonlimiting examples of such backfilling materials include waxes, glycols, oils, alkyds, urethanes, acrylics, and the like. Preferably, for greater structural integrity, one can crosslink these backfilling materials using techniques known to those skilled in the art.

Impregnation of the salt or silica can be accomplished in any of the following manners:

Silica agglomerate can be prepared by reacting a colloidal silica sol (average particle size~4 nm) in a three-neck flask fitted with a reflux condenser and a mechanical stirrer with isopropylamine or quinuclidine under stirring at room temperature, followed by adding dropwise to the mixture, at room temperature, diluted hydrofluoric acid under stirring. After the addition of all the acid, the system can be heated to vigorous refluxing of water under moderate mechanical stirring for more than a day. After this period of time an opaque colloidal dispersion results, which can be combined with surfactants and binder. Impregnation of the dispersion can be carried out into the porous substrate by conventional coating techniques, such as a slot fed knife, rotogravure devices, padding operations, dipping, spraying, etc.

For the metal salt embodiment, the salt/surfactant(s) are dissolved or mixed in a mixture of de-ionized water and an alcohol. Impregnation or imbibing of the solution is done with conventional coating equipment like a slot fed knife, rotogravure devices, padding operations, dipping, spraying, etc. It is preferred that the coating composition fill the pores of the substrate without leaving substantial quantities on the surface. Excessive amounts of high solids coatings could plug the pores as the water/alcohol evaporate which in turn causes smearing and slow dry times during inkjet printing.

Optional additives can be added before, during, or after the impregnation of the pigment management system.

Before or after the principal receptor is prepared, optional adhesive or mechanical fastener laminates can be added using commercially acceptable coating or extrusion techniques.

Usefulness of the Invention

Inks

The printing industry has previously employed dye-based inks, although pigment-based inks are becoming more prevalent. Use of pigment colorants is preferred over dye colorants because of durability and ultraviolet light stability in outdoor applications.

Further, reference to inks with respect to this invention concerns aqueous-based inks, not solvent-based inks. Aqueous-based inks are currently preferred in the printing industry for environmental and health reasons, among other reasons.

Minnesota Mining and Manufacturing Company (3M) produces a number of excellent pigmented inkjet inks for thermal inkjet printers. Among these products are Series 8551; 8552; 8553; and 8554 pigmented ink jet inks. The use of four principal colors: cyan, magenta, yellow, and black permit the formation of as many as 256 colors or more in the digital image. Further, pigmented inkjet inks, and components for them, are also produced by others, including Hewlett Packard, DuPont, and a number of other companies that can be located at many commercial trade shows dedicated to the imaging and signage industries.

Image Graphics

The receptor of the present invention is a highly fluid absorptive inkjet medium. The porous receptor is opaque because of its inherent light scattering ability. Using clear backing support, the receptor can be used for either reflective or backlit applications.

When the receptor material of this invention is imaged in Encad Novajet wide-format printers with high drop volume, it results in images with excellent quality with high color density which instantaneously dry to touch or any other dry tests.

Figure 2:
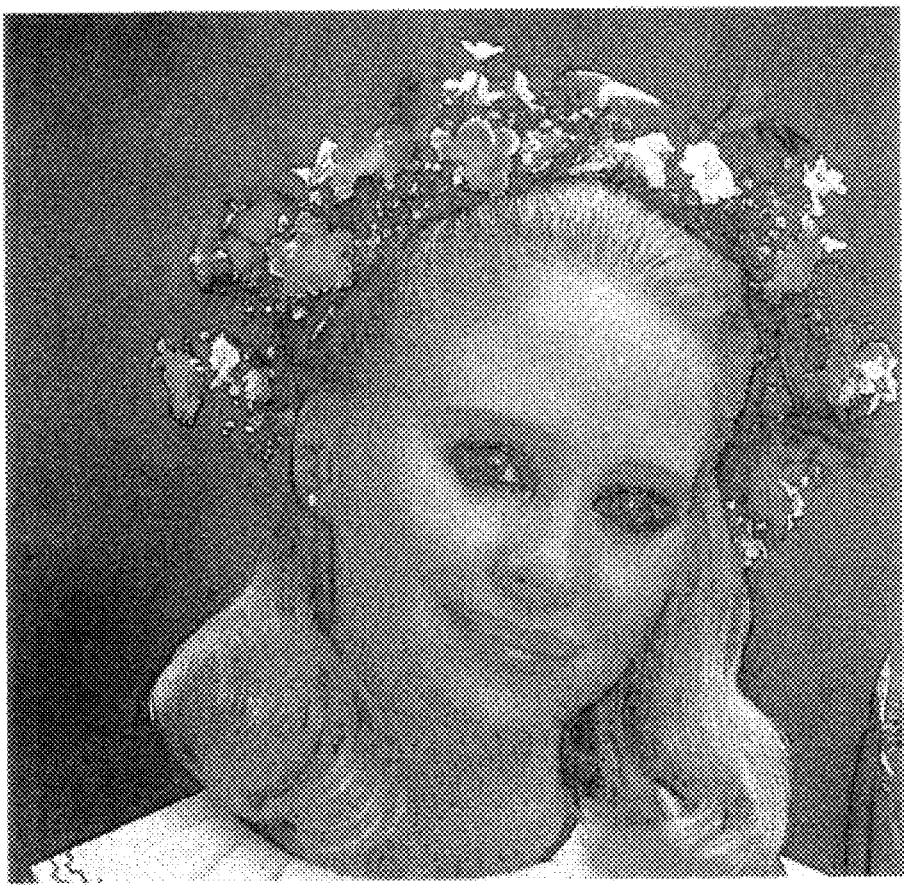
FIG. 2 discloses a comparison color photograph showing a receptor medium that has a fluid management system but no pigment management system.

As demonstrated by the following comparison, the usefulness of the present invention becomes apparent. FIG. 1 is color photograph of a color inkjet image protected by an overlaminate and prepared using the receptor of the present invention, specifically including a multivalent salt as the pigment management system therein. FIG. 2 (Comparison) is the same color ink jet image using the same inks and printer and overlaminate as used to prepare the image of FIG. 1, except that, no pigment management system is present. No metal salt is impregnated into the pores of the receptor.

A picture is worth a thousand words. Briefly, but not being limited by a particular theory, the presence of the salt impregnated into pores provides instantaneous capturing of the pigment particles just below the surface of the porous receptor and controls the depth the pigment particles go to by destabilizing, flocculating, agglomerating, or coagulating them from their suspension/dispersion in the ink.

Further embodiments and their unexpected advantages over the art are described in the following examples.

EXAMPLES

Unless otherwise stated, all examples use an oil-in microporous polypropylene film made according to the teachings of of U.S. Pat. No. 5,120,594 with the following pore properties: 175 $\mu$m thick; a pore size of 0.65 $\mu$m; Gurley resistance to air flow of 20 seconds to pass 50 cc through 2.54 $cm^2$; and 40–42% porosity. The porous film was attached to a 175 $\mu$m thick paper liner using 3M adhesive disclosed in EPO Pat. Pub. EP 0 570 515 B1 (Steelman et al.) (with 50 parts of aqueous pressure sensitive adhesive and 43.5 parts of adhesive microspheres) to allow it to travel smoothly through an Encad Nova Jet III printer fitted with 140 picoliter/drop HP 51626 cartridges filled with 3M pigmented inks.

The first four examples describing the receptor media of the invention were impregnated with a UV and thermal stabilizing coating solution before the pigment/fluid management solution was applied. Both solutions were flood coated on the porous film and wiped with a #4 Meyer rod. The film was dried at ambient conditions. The stabilizing solution could also be applied after the receptor coating.

| | |
|---|---|
| Tinuvin-1130 | 2% |
| Tinuvin-123 | 3.5% |
| Irganox-1010 | 0.4% |
| Acetone | 1% |
| Ethanol | 93.1% |

Example-1

This example shows a receptor composition consisting of a single multivalent metal salt and a mixture of a non-ionic fluorochemical and an anionic hydrocarbon-based surfactants flood-coated with a Meyer rod #4 onto the oil-in-PP porous film. The film was dried in air at ambient conditions. After printing, the receptor was dry to the touch and had excellent image quality. Color density measurements are listed in Table 1. The measurements were taken with a Gretag SPM-50 colorimeter in reflectance mode set at:

| | |
|---|---|
| Illumination | D65 |
| Observation angle | 2° |
| Density Standard | DIN |
| White base | Abs |
| Filter | none |

Receptor Composition 1

| | |
|---|---|
| Aluminum sulfate | 5.0 wt % |
| Zonyl-FSO (fluorochemical surfactant, Dupont) | 1.0 wt % |
| Dioctylsulfosuccinate-Na-salt (hydrocarbon surf., Cyanamid) | 1.0 wt % |
| Isopropyl Alcohol | 15 wt % |
| Ethyl Alcohol | 10 wt % |
| De-ionized water | 68 wt % |

Example-2

This example shows a composition consisting of a single multivalent metal salt and a mixture of a non-ionic fluorochemical and an anionic hydrocarbon-based surfactant flood-coated onto the oil-in-PP porous film with a Meyer rod #4. The film was dried in air at ambient conditions. After printing the receptor was dry to the touch and had excellent image quality. Color density values are listed in Table 1.

Composition-II

| | |
|---|---|
| Aluminum sulfate | 5.0 wt % |
| FC-170C (fluorochemical surfactant, 3M) | 1.0 wt % |
| Dioctylsulfosuccinate-Na-salt | 1.0 wt % |
| Isopropyl Alcohol | 15 wt % |
| Ethyl Alcohol | 10 wt % |
| De-ionized water | 68 wt % |

Example-3

This example shows a composition consisting of a single multivalent metal salt and a mixture of a non-ionic silicon-based surfactant e.g., a Silwet L-7607 compound and an anionic hydrocarbon-based surfactant flood-coated onto the oil-in-PP porous film with a Meyer rod #4. The film was dried in air at ambient conditions. After printing the receptor was dry to the touch and had excellent image quality. Color density measurements are in Table 1.

Composition-III

| | |
|---|---|
| Aluminum sulfate | 5.0 wt % |
| Silwet L-7607 (Silicon surfactant, Union Carbide) | 1.0 wt % |
| Dioctylsulfosuccinate-Na-salt (hydrocarbon surf., Cyanamid) | 1.0 wt % |
| Isopropyl Alcohol | 15 wt % |
| Ethyl Alcohol | 10 wt % |
| De-ionized water | 68 wt % |

Example-4

This example shows a composition consisting of a mixture of binary metal salts and a fluorochemical and hydrocarbon-based surfactants flood-coated onto the oil-in-PP porous film with a Meyer rod #4. The film was dried in air at ambient conditions. After printing the receptor was dry to the touch and had excellent image quality. Color density measurements are in Table 1.

Composition-IV:

| | |
|---|---|
| Potassium-Aluminum sulfate | 1.66 wt % |
| Ammonium-Aluminum sulfate | 1.67 wt % |
| Ferrous-Aluminum sulfate | 1.67 wt % |
| Zonyl-FSO* (fluorochemical surfactant) | 1.0 wt % |
| Dioctylsulfosuccinate (hydrocarbon surf., Cyanamid) | 1.0 wt % |
| Isopropyl Alcohol | 25 wt % |
| De-ionized water | 68 wt % |

TABLE 1

COLOR DENSITY MEASUREMENTS

| Composition | Color Density | | | | | | |
|---|---|---|---|---|---|---|---|
| | Black | Cyan | Magenta | Yellow | Red | Green | Blue |
| II (unlaminated) | 1.26 | 1.24 | 1.11 | 1.14 | 1.16 | 1.22 | 1.21 |
| II (laminated) | 1.75 | 1.48 | 1.32 | 1.41 | 1.43 | 1.50 | 1.47 |
| III (unlaminated) | 1.24 | 1.23 | 1.13 | 1.12 | 1.16 | 1.23 | 1.20 |
| III (laminated) | 1.73 | 1.49 | 1.36 | 1.40 | 1.46 | 1.53 | 1.51 |
| IV (unlaminated) | 1.22 | 1.22 | 1.11 | 1.16 | 1.16 | 1.22 | 1.22 |
| IV (laminated) | 1.70 | 1.46 | 1.33 | 1.42 | 1.43 | 1.54 | 1.51 |
| V (unlaminated) | 1.24 | 1.20 | 1.01 | 1.17 | 1.10 | 1.20 | 1.18 |
| V (laminated) | 1.55 | 1.45 | 1.15 | 1.41 | 1.30 | 1.46 | 1.35 |

Example 5

This example shows a receptor composition of a single multivalent metal salt and a mixture of a non-ionic hydrocarbon surfactant and an anionic hydrocarbon surfactant flood coated onto the porous film with a #4 Meyer rod. The film was dried in air at ambient conditions. After printing the receptor was dry to the touch and had excellent image quality.

Composition V.

| | |
|---|---|
| dioctylsulfosuccinate-Na-salt | 2.0 wt % |
| Pluronic 25R4 | 2.0 wt % |
| aluminum sulfate | 7.5 wt % |
| ethyl alcohol | 25 wt % |
| de-ionized water | 63.5 wt % ≈ |

Comparative Example A

This is an example of coating solution that does not contain a multivalent metal salt, just an anionic hydrocarbon surfactant. The solution composition was 7 wt % dioctylsulfosuccinate-Na-salt, 46.5 wt % water, and 46.5 wt % ethanol. It was flood-coated onto the oil-in porous film using a #4 Meyer rod and dried in air at ambient condition. After printing the receptor was dry to the touch, but all the measured reflected optical densities were poor.

The red color bar is composed of a mixture of 100% lay down of magenta and 100% lay down of yellow, in that order. Looking at the individual colors from Comparative Example A, the 100% lay down of magenta has a reflected optical density measurement of 0.86 and the 100% lay down of yellow has an optical density of 0.92. However, the optical density of the magenta component in the red color falls to 0.59 while the optical density of the yellow component slightly increases. The magenta colorant is beneath the yellow colorant in the film and is visually trapped. The visual effect of this is a washed out yellow orange color that is supposed to be red.

Compare those results with Example 5. Using this invention, all the measured optical densities of the colors are greater because the pigments are closer to each other and to the surface of the film. Another measurable result is the magenta component in red slightly increases while the yellow component slightly decreases. This results from pigments that have mixed better in the porous film so the previous observed color trapping is minimized or eliminated. The porous film utilized by this invention for ink jet imaging resulted in truer colors with higher optical densities while enjoying instantaneous dry time.

In the present invention, the ink carrier fluid is wicked instantly into the film so the surface remains tack free. This enables the film to be picked up for lamination, stacked, or rolled up immediately after printing. The real dry time is when all the volatile components in the ink have evaporated out of the membrane. This may take up to a half hour or more depending on temperature and humidity.

Example 6

This example describes a continuous coating process for the pigment/fluid management solution composition as applied to a roll 200 meters long of oil-in-PP porous film laminated to a paper liner using 3M's adhesive disclosed in EPO Pat. Pub. EP 0 570 515 B1 (Steelman et al.), as above. A composition similar to Example 3 was used except the aluminum sulfate was 4.63 wt %, the dioctlysulfosuccinate-Na-salt was 7.0 wt %, and the water was 62.37 wt %. The solution was fed to a slot knife by a gear pump at a rate where the solution flood coated the porous film but not in excess. The coated web was fed into a forced air oven at 4.6 meters/min maintained at 100° C. and wound on a core. The receptor material was imaged on a Encad Nova Jet III with 3M pigmented ink, Encad "GO" pigmented ink, and Graphic Utilities pigmented ink where it was found that all of the images, regardless of which ink was used in printing, were dry to touch, waterfast, smudge and smear resistant immediately out of the printer, and had excellent reflective image quality with and without an overlaminate.

Example 7

This example shows a receptor composition consisting of a multivalent metal salt and a mixture of two nonionic surfactants and one anionic surfactant flood-coated onto the oil-in PP porous film and wiped with a #4 Meyer rod. The film was dried in air at ambient conditions. Immediately after printing the image was dry to the touch, the colors did not smear when rubbed, and the image quality was excellent because the dispersed pigment in the ink was rapidly agglomerated and captured below the surface as it entered the porous film.

Composition VII:

| | |
|---|---|
| Aluminum sulfate | 6.0 wt % |
| Surfynol 104 | 2.0 wt % |
| Silwet L-7607 | 1.0 wt % |
| Dioctylsulfosuccinate-Na-salt | 7.0 wt % |
| ethyl alcohol | 25.0 wt % |
| de-ionized water | 59.0 wt % |

Comparative Example B

The same solution as in Example 7 was prepared except no metal salt was added. The solution was flood-coated onto an oil-in PP porous film and wiped with a Meyer rod and dried. After printing, the image was dry to the touch, but the color densities were dull and diffuse because the dispersed pigment in the ink was not rapidly destabilized and agglomerated.

Example 8

A commercially available hydrophilic nylon membrane from Gelman Sciences, Ann Arbor, Mich., called Nyloflo 0.2 μm was flood-coated with a 5.25 wt. % aluminum sulfate solution in water, wiped with a #4 Meyer rod and dried at ambient conditions. During printing, the image dried instantly and the color densities were high.

Comparative Example C

The same nylon membrane used in Example 8 without the metal salt coating was imaged. The image dried instantly during printing, but the colors were dull and diffuse because the dispersed pigment in the ink was not destabilized and agglomerated.

Example 9

A commercially available hydrophobic polysulfone 0.45 μm membrane from Gelman Sciences was coated with a 5.25 wt. % aluminum sulfate, 9.0 wt. % dioctylsodium sulfosuccinate, 25.0 wt. % ethanol, 60.75 wt % de-ionized water solution, wiped with a #4 Meyer rod, and dried at ambient conditions. During printing, the image dried instantly and the color densities were high.

Comparative Example D

The same membrane used in Example 9 was flood-coated with a 6.0 wt % solution of dioctylsodium sulfosuccinate solution without the metal salt, wiped with a #4 Meyer rod, and dried at ambient conditions, and imaged. The image dried instantly during printing, but the colors were dull and diffuse.

Example 10

A commercially available hydrophilic ethylene vinyl alcohol copolymer (EVAL) 0.5 μm membrane from 3M was flood-coated with 5.25 wt % aluminum sulfate in water, wiped with a #4 Meyer rod, and dried at ambient conditions. During printing, the image dried instantly and the color densities were high.

Comparative Example E

The same membrane used in Example 10 without a metal salt coating was used for inkjet printing. The imaged area dried instantly, but the colors were dull and diffuse because the dispersed pigment in the ink travel through the membrane and was not destabilized and agglomerated.

Comparative Example F

This example shows a receptor coating consisting of the pigment management system: 5.25 wt % aluminum sulfate; 30 wt % ethanol; and 64.75 wt % de-ionized water, coated on the hydrophobic oil-in PP porous film. No fluid management system was used to wick away the inkjet ink carrier fluids. The solution was flood-coated, wiped with a #4 Meyer rod, and dried at ambient conditions. During and after printing, the image dried very slowly, was distorted, and had unacceptable quality because the pigmented inks pooled on the surface of the membrane, did not soak in, and coalesced as well.

Example-11

This example describes one method of preparation of the functionalized silica, a $SiO_2$-i-pr-$NH_2$-HF system:

To 100 g (15% solid, 15g, 0.245 mole) of a colloidal silica sol (Nalco 2326, average particle size~4 nm) in a three-neck flask fitted with a reflux condenser and a mechanical stirrer was added 45 g (0.75 mole) isopropylamine under stirring at room temperature. To the mixture was dropwise added, at room temperature, after dilution with 100 g de-ionized water, 30 g (50% in water, 15 g, 0.75 mole) hydrofluoric acid under stirring. The system was somewhat exothermic and during the addition of acid 50 g de-ionized water was added under stirring to disperse the formed gel. After the addition of all the acid, the system was heated to vigorous refluxing of water under mechanical stirring of about 150–200 rpm. After 3–4 days a white colloidal system resulted.

The material in combination with a binder copolymer of n-vinylpyrrolidone and dimethylaminoethylmethacrylate (copolymer-958, from ISP) was coated onto a polyvinyl chloride (PVC) base and dried at 100° C. for 4 mins. The dry coating was subjected to SEM analysis which shows a highly microporous surface. The colloidal material in very dilute suspension was subjected to TEM analysis which shows an agglomerated morphology. X-ray powder diffraction shows the material to be microcrystalline morphology. BET specific surface area measurement shows that the sample has a SSA of about 210–250 $m^2/g$ with a pore volume of 0.12 cc/g and a pore diameter of 110–140A°. The surface shows a rate of absorption of ink (water) in the range of 25–50 $ml/m^2/sec$.

Example-12

This example describes another method of preparation of the functionalized silica.

To 40 g (15% solid, 6 g, 0.10 mole) of a colloidal silica sol (Nalco 2326, average particle size~4 nm) in a three-neck flask fitted with a reflux condenser and a mechanical stirrer was added 10 g (0.08 mole) quinuclidine under stirring at room temperature. To the mixture was dropwise added, at room temperature, after dilution with 110 g de-ionized water, 8 g (50% in water, 4 g, 0.20 mole) hydrofluoric acid under stirring. After the addition of all the acid, the system was heated to vigorous refluxing of water under mechanical stirring of about 100–200 rpm for 18 hr. After this period of time an opaque colloidal dispersion resulted.

Example-13

This example shows the functionalized silica coating composition flood-coated onto the microporous oil-in-PP using a Meyer rod #4 and drying the film in air or by brief heating using a heat gun. The composition was also coated using machine coating, as described in Example 6.

Composition-13:

| | |
|---|---|
| Fluorinated microporous silica | 2–3% |
| Binder Polymer (Cop-958)* | 0.5–0.7% |
| Dioctylsulfosuccinate-Na-salt, DOS[3] (Cyanamid) | 1.5–2.0% |
| Isopropyl Alcohol | 80–85% |
| DI-water | 10–12% |

*NVP/DMAEMA (20/80)

Example-14

This example shows another coating composition coated onto the microporous oil-in-pp. The composition was flood-coated onto the oil-in-pp using a Meyer bar #4 and the film was dried in air or optionally using brief heating with heat gun. The dry film was imaged in various wide-format commercial printers.

Composition-14(a):

| | |
|---|---|
| Fluorinated microporous silica | 2–3% |
| Binder Polymer (Cop-958)* | 0.5–0.7% |
| Fluorochemical surfactant (Zonyl-FSO, Dupont) | 0.5–1.0% |
| Dioctylsulfosuccinate-Na salt, Dos[3] (Cyanamid) | 0.5–1.0% |
| Isopropyl Alcohol | 30–40% |
| DI-water | 50–55% |

*NVP/DMAEMA (20/80)

Composition 14(b) & (c):

These compositions are the same as composition 14(a) except that for 14(b) fluorochemical surfactant FC-170C and for 14(c) silicon-based surfactant Silwet L-7607were used.

Example-15

This example shows another coating composition coated onto the microporous oil-in-pp. The composition was flood-coated onto the oil-in-pp using a Meyer bar #4 and the film was dried in air or optionally using brief heating with heat gun. The dry film was imaged in various wide-format commercial printers.

Composition-15:

| | |
|---|---|
| Fluorinated microporous silica | 2–3% |
| Binder Polymer (Cop-958)* | 0.5–0.7% |
| Fluorochemical surfactant (Zonyl-FSO, Dupont) | 0.5–1.0% |
| Isopropyl Alcohol | 30–40% |
| DI-water | 50–55% |

*NVP/DMAEMA (20/80)

Example-16

(a) This example shows the image density on the developed receptor coated with composition-13 (example-13) of different colors imaged in an Encad-Novajet-III wide-format printer—the final image being laminated and unlaminated.

TABLE 2

COLOR DENSITY MEASUREMENTS

| Film | Color Density | | | | | | |
|---|---|---|---|---|---|---|---|
| | Black | Cyan | Magenta | Yellow | Red | Green | Blue |
| Comp-13 (unlaminated)*,@ | 1.30 | 1.04 | 0.91 | 1.17 | 1.02 | 1.05 | 0.84 |
| Comp-13 (unlaminated)*,& | 1.22 | 1.15 | 1.10 | 1.19 | 1.11 | 1.15 | 1.11 |
| Comp-13 (laminated)*,& | 1.77 | 1.32 | 1.32 | 1.49 | 1.37 | 1.40 | 1.35 |
| Comp-13 (unlaminated)#,$ | 1.28 | 1.21 | 1.10 | 1.23 | 1.20 | 1.19 | 1.16 |
| Comp-13 (laminated)*,$ | 1.57 | 1.38 | 1.50 | 1.57 | 1.62 | 1.50 | 1.45 |

*using silica from example - 11,
#using silica from example - 12
@using Rev-1 ink set,
$using Rev-1/N-magenta ink set
&using modified black/N magenta (b) This example shows the image density on the developed receptor coated with composition-14(a) (Example-14) of different colors imaged in an EnCad-Novajet-III wide-format printer—the final image being laminated and unlaminated.

TABLE 3

COLOR DENSITY MEASUREMENTS

| Film | Color Density | | | | | | |
|---|---|---|---|---|---|---|---|
| | Black | Cyan | Magenta | Yellow | Red | Green | Blue |
| Comp-14(a) (unlaminated)*,& | 1.21 | 1.19 | 1.09 | 1.29 | 1.26 | 1.29 | 1.18 |
| Comp-14(a) (laminated)*,$ | 1.74 | 1.41 | 1.33 | 1.66 | 1.57 | 1.59 | 1.51 |

(c) These examples show the image densities on the developed receptors coated with composition-14(b) and 14(c) (Example-14) of different colors imaged in an Encad-Novajet-III wide-format printer—the final image being laminated and unlaminated.

TABLE 4

COLOR DENSITY MEASUREMENTS

| Film | Color Density | | | | | | |
|---|---|---|---|---|---|---|---|
| | Black | Cyan | Magenta | Yellow | Red | Green | Blue |
| Comp-14(b) (unlaminated)*,& | 1.23 | 1.10 | 1.05 | 1.24 | 1.10 | 1.19 | 1.13 |
| Comp-14(b) (laminated)*,& | 1.71 | 1.32 | 1.31 | 1.58 | 1.55 | 1.56 | 1.45 |
| Comp-14(c) (unlaminated)*,& | 1.27 | 1.13 | 1.08 | 1.21 | 1.17 | 1.18 | 1.13 |

TABLE 4-continued

| COLOR DENSITY MEASUREMENTS | | | | | | | |
|---|---|---|---|---|---|---|---|
| | Color Density | | | | | | |
| Film | Black | Cyan | Magenta | Yellow | Red | Green | Blue |
| Comp-14(c) (laminated)*,& | 1.71 | 1.39 | 1.39 | 1.62 | 1.50 | 1.45 | 1.42 |

(d) This example shows the image density on the developed receptor coated with composition-15 (Example-15) of different colors imaged in an Encad-Novajet-III wide-format printer—the final image being laminated and unlaminated.

TABLE 5

| COLOR DENSITY MEASUREMENTS | | | | | | | |
|---|---|---|---|---|---|---|---|
| | Color Density | | | | | | |
| Film | Black | Cyan | Magenta | Yellow | Red | Green | Blue |
| Comp-15 (unlaminated)*,& | 1.25 | 1.12 | 1.04 | 1.23 | 1.16 | 1.21 | 1.13 |
| Comp-15 (laminated)*,& | 1.70 | 1.30 | 1.27 | 1.47 | 1.44 | 1.50 | 1.41 |

Example-17

This example shows a comparison of the image densities in Example-16(a) to those in the receptors obtained by replacing the microporous silica with the commercially available ones.

TABLE 6

| COLOR DENSITY MEASUREMENTS | | | | | | | |
|---|---|---|---|---|---|---|---|
| | Color Density | | | | | | |
| Film | Black | Cyan | Magenta | Yellow | Red | Green | Blue |
| Comp-13 (unlaminated)*,@ | 1.30 | 1.04 | 0.91 | 1.17 | 1.02 | 1.05 | 0.84 |
| Comp-13 (unlaminated)*,& | 1.22 | 1.15 | 1.10 | 1.19 | 1.11 | 1.15 | 1.11 |
| Comp-13 (laminated)*,& | 1.77 | 1.32 | 1.32 | 1.49 | 1.37 | 1.40 | 1.35 |
| Comp-13 (unlaminated)#,$ | 1.28 | 1.21 | 1.10 | 1.23 | 1.20 | 1.19 | 1.16 |
| Comp-13 (laminated)*,$ | 1.57 | 1.38 | 1.50 | 1.57 | 1.62 | 1.50 | 1.45 |
| Ludox+ silica | 0.88 | 0.77 | 0.76 | 1.00 | 0.62 | 1.04 | 0.73 |
| Spherical silica | 0.87 | 0.79 | 0.83 | 0.95 | 0.64 | 1.05 | 0.78 |

*using silica from example - 11,
#using silica from example - 12
@using Rev-1 ink set,
$using Rev-1/N-magenta ink set
&using modified black/N magenta
+Ludox silica commercially available from DuPont of Wilmington, Delaware, USA
Spherical silica commmercially available from Nissan Chemicals Inds. Ltd. of Tokyo, Japan Example-18

This example shows the compositions, consisting of fluorinated silica of Example-11, developed for a single-layer coating onto various substrates e.g., polyvinyl chloride, polyester, microvoided polyester, paper, polycarbonate etc. The compositions were coated onto various substrates using a knife-coater at various wet % of solids typically 18–22%. The coated films were dried for 3–4 mins. in an air-forced oven operating at 105° C.

| | |
|---|---|
| (a) Composition 18(a): | |
| Fluorinated microporous silica | 60% |
| Copolymer-958* | 39% |
| Fluorochemical surfactant@ | 0.5–1% |
| (b) Composition 18(b): | |
| Fluorinated microporous silica | 58% |
| Copolymer-958* | 38% |
| Snowtax# | 3% |
| Fluorochemical surfactant@ | 0.5–1.0% |

*NVP/DMAEMA (from ISP);
#Spherical silica (from Nissan Chemical);
@Zonyl FSO (from E.I. Dupont)

Example-19

This example shows the image density of the coated PVC with composition 18(a) and 18(b) in the wide-format Encad Novajet inkjet printer operating with both dye- and pigment-based inks.

TABLE 7

| COLOR DENSITY MEASUREMENTS | | | | | | | | |
|---|---|---|---|---|---|---|---|---|
| | | Color Density | | | | | | |
| Comp. | Ink type | Black | Cyan | Magenta | Yellow | Red | Green | Blue |
| 18(b) | Pigment* | 1.20 | 1.22 | 0.85 | 0.84 | 0.85 | 1.12 | 1.01 |
| 18(a) | Dye* | 1.53 | 1.54 | 1.23 | 1.56 | 1.35 | 1.50 | 1.41 |
| 18(a) | Dye# | 2.07 | 1.97 | 1.35 | 1.90 | 1.70 | 1.90 | 1.76 |

*no overlaminate,
#overlaminate

The invention is not limited to the above embodiments. As seen in the last Example, it is possible to employ the silica agglomerate pigment management system successfully with respect to dye-based inks, recognizing that such inks will continue to have a place in specific markets even after preferred pigment-based inks become dominant in the image graphics industry. Others skilled in the art will appreciate other possible combinations of pigment management systems and fluid management systems will be feasible for a variety of inks and media once having been exposed to the scope of the present invention. The claims follow.

What is claimed is:

1. An inkjet receptor medium comprising:

a porous substrate having a fluid management system and a pigment management system in contact with surfaces of pores of the substrate, wherein the pigment management system comprises functionalized particulates within the pores of the porous substrate and the fluid management system comprises a surfactant.

2. The medium of claim 1, wherein the functionalized particulates comprise fluorinated silica agglomerates that interact with dispersant to agglomerate pigment particles as an ink containing the pigment particles passes through the pores.

3. The medium according to claim 1, wherein the surfactant is selected from the group consisting of fluorocarbon, silicon, hydrocarbon-based surfactants or a mixture thereof.

4. The medium according to claim 3, wherein the surfactant comprises a silicon-based non-ionic surfactant.

5. The medium according to claim 3, wherein the surfactant comprises a hydrocarbon surfactant of a fatty acid.

6. The medium according to claim 1, wherein the porous substrate comprises a microporous membrane.

7. The medium according to claim 6, wherein the microporous membrane comprises a polypropylene film co-extruded with a mineral oil followed by bi-axial stretching under thermal conditions.

8. The medium according to claim 7, wherein the microporous membrane is an opaque film.

9. The medium of claim 1, wherein the functionalized particulates comprise fluorinated silica agglomerates.

10. A method of using an inkjet receptor medium comprising:

(a) placing an inkjet receptor medium of claim 1 in an inkjet printer; and (b) printing an image on the medium using inkjet ink, wherein the inkjet ink comprises pigment particles.

11. The method according to claim 10, wherein the inkjet ink further comprises a dispersant.

12. A method of using an inkjet receptor medium comprising:

(a) placing an inkjet receptor medium of claim 1 in an inkjet printer; and (b) printing an image on the medium using inkjet ink.

13. The inkjet receptor medium of claim 1, wherein the size of the pores of the porous substrate is about 0.4$\mu$ or greater, and is no greater than about 2.0 $\mu$m, and wherein the pore size is a bubble point pore size measured according to ASTM F-316.

14. A method of making an inkjet receptor medium comprising:

(a) preparing a pigment management system;

(b) imbibing the pigment management system into pores of a porous substrate, wherein the pigment management system once imbibed into the pores comprises functionalized particulates within the pores of the porous substrate; and (c) imbibing a fluid management system into the pores of the porous substrate wherein the fluid management system comprises a surfactant.

15. An inkjet receptor median comprising:

a porous membrane of a synthetic polymer having a fluid management system and a pigment management system in contact with surfaces of pores of the membrane, wherein the pigment management system comprises a multivalent metal salt coating along the surfaces of the pores of the porous membrane, wherein the fluid management system comprises a surfactant, and further wherein the size of the pores of the porous membrane is at least 0.2 $\mu$m, and is no greater than about 2.0 $\mu$m, and wherein the pore size is a bubble point pore size measured according to ASTM F-316.

16. The medium according to claim 15, wherein the multivalent metal salt coating comprises a multivalent salt of cations derived from the elements of Group II and above in the Periodic Table within conditions of solubility rules, wherein the salt comprises a single salt oral binary salt or a ternary salt containing counterions selected from the group consisting of nitrate, nitrite, sulfate, sulfite, bisulfite, alkanesulfonate, fluoroalkanesulfonates, perchlorate, halide, pseudo-halides, acetate, propionate, and combinations thereof.

17. The medium according to claim 15, wherein the porous membrane comprises a microporous membrane.

18. The medium according to claim 17, wherein the microporous membrane comprises a polypropylene film co-extuded with a mineral oil followed by bi-axial stretching under thermal conditions.

19. The medium according to claim 17, wherein the microporous membrane is a phase separated membrane.

20. The medium according to claim 15, wherein the surfactant is selected from the group consisting of fluorocarbon, silicon, hydrocarbon-based surfactants or a mixture thereof.

21. The medium according to claim 20, wherein the surfactant comprises a hydrocarbon surfactant of a fatty acid.

22. The medium according to claim 15, furthre comprising an additional surfactant, wherein the additional surfactant is a silicon-based non-ionic surfactant.

23. The medium of claim 15, wherein the porous membrane of a synthetic polymer is a thermally induced phase separated microporous membrane.

24. A method of using an inkjet receptor medium comprising:

(a) placing an inkjet receptor medium of claim 15, in an inkjet printer; and (b) printing an image on the medium using inkjet ink, wherein the inkjet ink comprises pigment particles.

25. The method according to claim 24, wherein the inkjet ink further comprises a dispersant.

26. The inkjet receptor medium of claim 13, wherein the surfactant is an anionic surfactant.

27. The inkjet receptor medium of claim 22, wherein the size of the pores of the porous membrane are about 0.4$\mu$ or greater.

28. A method of using an inkjet receptor medium comprising:

(a) placing an inkjet receptor medium of claim 15 in an inkjet printer; and (b) printing an image on the medium using inkjet ink.

29. An inkjet receptor medium comprising:

a porous substrate having a fluid management system and a pigment management system in contact with surfaces of pores of the substrate wherein the pigment management system comprises fluorinated silica agglomerates that are capable of agglomerating pigment particles in a pigment-containing ink used to print the inkjet receptor medium.

30. A method of making an inkjet receptor medium comprising:

(a) preparing a pigment management system;

(b) imbibing the pigmemt management system into pores of a porous membrane of a synthetic polymer, wherein the pigment management system once imbibed into pores of the porous membrane comprises a multivalent metal salt coating along the surfaces of the pores of the porous membrane; and (c) imbibing a fluid management system into the pores of the porous membrane wherein the fluid management system comprises a surfactant, and further wherein the size of the pores of the porous membrane is at least 0.2 $\mu$m, and is no greater than about 2.0$\mu$m, and wherein the pore size is a bubble point pore size measured according to ASTM F-316.

31. The method of claim 30, wherein the surfactant is an anionic surfactant.

32. An inkjet receptor medium comprising a porous substrate comprising a multivalent metal salt coating and an anionic surfactant in contact with surfaces of pores of the porous substrate, and further comprising a pigmented ink image therein, wherein the size of the pores of the porous substrate is at least 0.2 $\mu$m, and is no greater than about 2.0 $\mu$m, and wherein the pore size is a bubble point pore size measured according to ASTM F-316.

33. An inkjet receptor medium comprising a porous substrate comprising fluorinated silica agglomerates in contact with surfaces of pores of the porous substrate.

34. The inkjet receptor medium of claim 33, further comprising a pigmented ink image thereon.

35. A method of making an inkjet receptor medium comprising:

(a) preparing a pigment management system;

(b) imbibing the pigment management system into pores of a thermally induced phase separated microporous membrane of a synthetic polymer, wherein the pigment management system once imbibed into pores of the microporous membrane comprises a multivalent metal salt coating along the surfaces of the pores of the microporous membrane; and (a) imbibing a fluid management system into the pores of the microporous membrane wherein the fluid management system comprises a surfactant, and further wherein the size of the pores of the microporous membrane is at least 0.2 $\mu$m, and is no greater than about 2.0 $\mu$m, and wherein the pore size is a bubble point pore size measured according to ASTM F-316.

* * * * *

UNITED STATES PATENT AND TRADEMARK OFFICE

CERTIFICATE OF CORRECTION

PATENT NO. : 6,632,510 B1
DATED : October 14, 2003
INVENTOR(S) : Waller, Clinton P. Jr.

It is certified that error appears in the above-identified patent and that said Letters Patent is hereby corrected as shown below:

Title page,
Item [56] References Cited, U.S. PATENT DOCUMENTS, 4,781,985, delete "Desarlais" and insert in place thereof -- Desjarlais --.

OTHER PUBLICATIONS, delete "Polymers-Polyvinylpryrrolidone" and insert in place thereof -- Polymers-Polyvinylpyrrolidone --.

Column 2,
Line 12, delete "predominately" and insert in place thereof -- predominantly --.

Column 3,
Line 9, delete "hydropilic" and insert in place thereof -- hydrophilic --.

Column 5,
Line 6, delete "process" and insert in place thereof -- processes --.
Line 17, delete "allowing" and insert in place thereof -- allows --.
Line 43, delete "according the" and insert in place thereof -- according to the --.
Line 45, delete "(Watchli et al.)" and insert in place thereof -- (Walchli) --.

Column 6,
Line 9, delete "overlarninates" and insert in place thereof -- overlaminates --.

Column 7,
Line 30, delete "according the" and insert in place thereof -- according to the --.
Line 64, delete "and".

Column 8,
Line 21, delete "(Arerosol TO)" and insert in place thereof -- (Arerosol OT) --.

Column 9,
Line 51, delete "according the" and insert in place thereof -- according to the --.

Column 10,
Line 2, delete "ternary" and insert in place thereof -- tertiary --.

UNITED STATES PATENT AND TRADEMARK OFFICE

CERTIFICATE OF CORRECTION

PATENT NO. : 6,632,510 B1
DATED : October 14, 2003
INVENTOR(S) : Waller, Clinton P. Jr.

It is certified that error appears in the above-identified patent and that said Letters Patent is hereby corrected as shown below:

Column 13,
Line 7, delete "which" and insert in place thereof -- which is --.
Line 33, delete "of".
Line 37, delete "175" and insert in place thereof -- 125 --.
Line 52, insert -- UV and Thermal Stabilizer Composition: --.
Line 64, delete "surfactants" and insert in place thereof -- surfactant --.

Column 14,
Line 63, delete "surfactants" and insert in place thereof -- surfactant --.

Column 15,
Line 65, delete "condition" and insert in place thereof -- conditions --.

Column 16,
Line 42, delete "dioctlysulfosuccinate" and insert in place thereof
-- dioctylsulfosuccinate --.

Column 17,
Line 16, delete "Meyer" and insert in place thereof -- #4 Meyer --.

Column 18,
Line 1, delete "travel" and insert in place thereof -- traveled --.

Column 19,
Line 39, delete "L-7607were" and insert in place therof -- L-7607 were --.

Column 23,
Line 36, delete "is" and insert in place therof -- are --, delete "0.4μ" and insert in place thereof -- 0.4 μm --.
Line 51, delete "median" and insert in place therof -- medium --.
Line 67, delete "oral" and insert in place thereof -- or a --.

UNITED STATES PATENT AND TRADEMARK OFFICE

CERTIFICATE OF CORRECTION

PATENT NO. : 6,632,510 B1
DATED : October 14, 2003
INVENTOR(S) : Waller, Clinton P. Jr.

It is certified that error appears in the above-identified patent and that said Letters Patent is hereby corrected as shown below:

Column 24,
Line 1, delete "ternary" and insert in place thereof -- tertiary --.
Line 10, delete "co-extuded" and insert in place thereof -- co-extruded --.
Line 21, delete "furthre" and insert in place therof -- further --.
Line 29, delete "15," and insert in place thereof -- 15 --.
Line 35, delete "of claim 13" and insert in place thereof -- of claim 15 --.
Line 37, delete "of claim 22" and insert in place thereof -- of claim 15 --.
Line 38, delete "0.4μ" and insert in place thereof -- 0.4 μm --.
Line 57, delete "pigmemt" and insert in place thereof -- pigment --.

Column 25,
Line 9, delete "therein" and insert in place thereof -- thereon --.

Column 26,
Line 10, delete "(a)" and insert in place thereof -- (c) --.

Signed and Sealed this

Fifth Day of October, 2004

JON W. DUDAS
*Director of the United States Patent and Trademark Office*

UNITED STATES PATENT AND TRADEMARK OFFICE
Certificate

Patent No. 6,632,510 B1 Patented: October 14, 2003

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Clinton P. Waller, Jr., White Bear Lake, MN (US); James S. Mrozinski, Oakdale, MN (US); Omar Farooq, Woodbury, MN (US); Thomas P. Klun, Lakeland, MN (US); Stefan H. Gryska, Woodbury, MN (US); and Larry R. Krepski, St. Paul, MN (US).

Signed and Sealed this Twenty-third Day of September 2008.

MILTON I. CANO
*Supervisory Patent Examiner*
Art Unit 1774